US010907917B2

(12) United States Patent
Roggen et al.

(10) Patent No.: US 10,907,917 B2
(45) Date of Patent: Feb. 2, 2021

(54) CARTRIDGE BOX FOR AMMUNITION BELT

(71) Applicant: FN Herstal S.A., Herstal (BE)

(72) Inventors: Patrick Roggen, Herstal (BE); Yannick Bailly, Herstal (BE); Frédéric Jadin, Herstal (BE); Olivier Jaspart, Herstal (BE)

(73) Assignee: FN Herstal S.A., Herstal (BE)

( * ) Notice: Subject to any disclaimer, the term of this patent is extended or adjusted under 35 U.S.C. 154(b) by 0 days.

(21) Appl. No.: 16/608,746

(22) PCT Filed: Apr. 24, 2018

(86) PCT No.: PCT/EP2018/060424

§ 371 (c)(1),
(2) Date: Oct. 25, 2019

(87) PCT Pub. No.: WO2018/197456

PCT Pub. Date: Nov. 1, 2018

(65) Prior Publication Data

US 2020/0200497 A1 Jun. 25, 2020

(30) Foreign Application Priority Data

Apr. 25, 2017 (BE) ..... 2017/5293

(51) Int. Cl.
*F41A 9/79* (2006.01)

(52) U.S. Cl.
CPC ..... *F41A 9/79* (2013.01)

(58) Field of Classification Search
CPC ..... F41A 9/79
See application file for complete search history.

(56) References Cited

U.S. PATENT DOCUMENTS 1,790,867 A * 2/1931 Jervey ..... F41A 9/79 89/33.16
1,901,868 A * 3/1933 Dabrasky ..... F41A 9/79 89/33.16
2,110,160 A * 3/1938 Larsson ..... F41A 9/79 89/34
2,339,869 A * 1/1944 Martin ..... F41A 9/54 89/34
2,388,958 A * 11/1945 Murphy ..... F41A 9/79 89/33.14
2,398,263 A * 4/1946 Trimbach ..... F41A 9/79 89/34

(Continued)

FOREIGN PATENT DOCUMENTS

CH 0077084 A1 4/1984
GB 0343825 A2 11/1989

*Primary Examiner* — Michelle Clement
(74) *Attorney, Agent, or Firm* — Leydig, Voit & Mayer, Ltd.; Gerald T. Gray

(57) ABSTRACT

The present invention relates to a cartridge box comprising: —a box (1) comprising an intake (5) and an outlet (6), the outlet (6) being placed under the intake (5) and separated from same by a guide roller (3); —a plurality of compartments (9) separated by partitions (2); —a belt (7) of cartridges (8), said cartridge belt crossing the intake (5), then folding into the compartments (9), from the compartment (9) closest to the intake (5) to the compartment that is furthest away, and then crossing the outlet (6), above the guide roller (3).

7 Claims, 5 Drawing Sheets

(56) References Cited

U.S. PATENT DOCUMENTS 2,452,545 A * 11/1948 Broga ..... F41A 9/79 89/34
2,470,475 A * 5/1949 Diaper ..... F41A 9/79 89/34
2,573,774 A * 11/1951 Sandberg ..... F41A 9/79 89/34
2,710,561 A * 6/1955 Dowd ..... F41A 9/79 89/34
2,811,084 A * 10/1957 Cook ..... F41A 9/79 89/34
2,874,615 A * 2/1959 Kravik ..... F41A 9/79 89/34
2,889,751 A * 6/1959 Bilek ..... F41A 9/79 89/34
3,461,774 A * 8/1969 Maurer ..... F41A 9/79 89/34
4,009,638 A * 3/1977 Ramseyer ..... F41A 9/79 89/34
4,393,746 A * 7/1983 Rocha ..... F41A 9/79 89/34
4,494,440 A * 1/1985 Koine ..... F41A 5/18 89/135
4,573,395 A * 3/1986 Stoner ..... F41A 9/81 198/792
4,610,191 A * 9/1986 Schmid ..... F41A 9/79 89/34
4,681,019 A * 7/1987 Brandl ..... F41A 9/76 89/33.04
4,876,940 A * 10/1989 Aloi ..... F41A 9/76 89/33.16
4,882,972 A * 11/1989 Raymond ..... F41A 9/04 89/34
4,974,490 A * 12/1990 Austin ..... F41A 9/79 89/34
5,115,713 A * 5/1992 Muller ..... F41A 9/04 89/33.14
5,149,909 A * 9/1992 Hagen ..... F41A 9/76 89/33.16
6,164,180 A * 12/2000 Sulm ..... F41A 9/79 89/33.04
6,389,948 B1 * 5/2002 Beckmann ..... F41A 9/04 89/33.14
7,913,610 B2 * 3/2011 Ulveraker ..... F42B 39/26 89/33.14
8,763,511 B2 * 7/2014 Schvartz ..... F41A 9/34 89/33.2
10,203,175 B2 * 2/2019 Lung ..... F41A 9/86
2010/0011946 A1 * 1/2010 Ulveraker ..... F42B 39/26 89/34

* cited by examiner

CARTRIDGE BOX FOR AMMUNITION BELT

SUBJECT OF THE INVENTION

The present invention relates to a cartridge box for ammunition in the form of a belt, comprising cartridges joined together by links.

PRIOR ART

A person skilled in the art is familiar with using compartment boxes for storing and delivering to an automatic weapon cartridges that are joined together in the form of ammunition belts by links. The document U.S. Pat. No. 2,811,084 describes for example such a box.

These prior art boxes have a number of limitations, however: the number of cartridges available is limited by the size of a single box, the position of the box is determined a priori and there is no flexibility with respect to this position.

However, these cartridge boxes are mainly used in applications on-board craft such as the sides of helicopters, for which there is no possibility of reloading in flight. Moreover, on this type of vehicle, the shape of the available space for the cartridge boxes is defined more by aerodynamic or balance-related constraints than by the practical aspect of storing ammunition. Therefore, the possibility of distributing the ammunition over several smaller boxes represents a key advantage. These boxes also have to be able to be disposed in any position in order to be adaptable to several types of weaponry for standardization purposes.

AIMS OF THE INVENTION

The present invention has the aim of providing a cartridge belt for ammunition in the form of a belt that exhibits the best flexibility in terms of positioning and capacity.

SUMMARY OF THE INVENTION

The present invention relates to a cartridge box comprising:

- a box comprising an inlet and an outlet, the outlet being positioned under the inlet and being separated therefrom by a turn roller;
- a plurality of compartments separated by partitions;
- a belt of cartridges, said cartridge belt passing through the inlet, then being folded up in the compartments, from the compartment closest to the inlet to the farthest away compartment, the belt then passing through the outlet, over the top of the turn roller.

Advantageously, the cartridge box of the invention comprises a second inlet and a second outlet separated by a second turn roller on the opposite face of the box such that it is possible to position the inlet and the outlet equally on the left-hand side or on the right-hand side of the cartridge box.

Preferably, the cartridge box of the invention comprises a removable cover for easily reversing the outlet side of the belt.

Preferably, a permanent magnet is disposed at the bottom of each compartment, each magnet making it possible to keep the cartridge belt in the compartment regardless of the position of the box.

When the cartridge box is preferably used with the inlet/outlet at the bottom of the box (upside down), the face of the walls of the compartments that is on the opposite side from the inlet/outlet side may comprise cells that help to keep the belt static.

The present invention also relates to an assembly of at least two cartridge boxes according to the invention, wherein the cartridge belt exiting the first box is connected to the belt entering the second box.

DETAILED DESCRIPTION OF THE INVENTION

Figure 1:
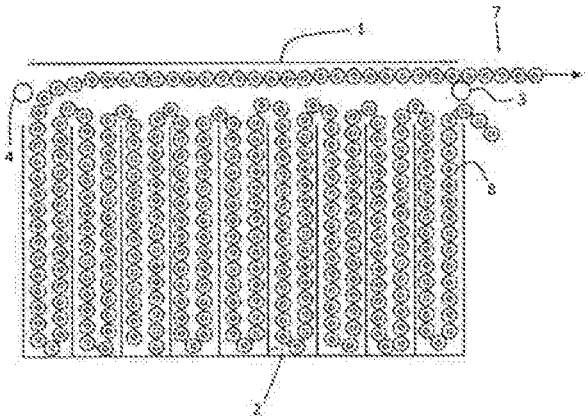
FIG. 1 shows a filled cartridge box according to the invention.
Figure 2:
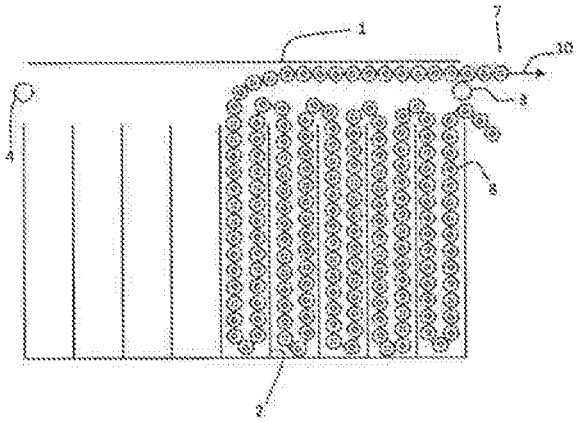
FIGS. 2 to 5 show the successive steps of emptying the cartridge box in FIG. 1.
Figure 3:
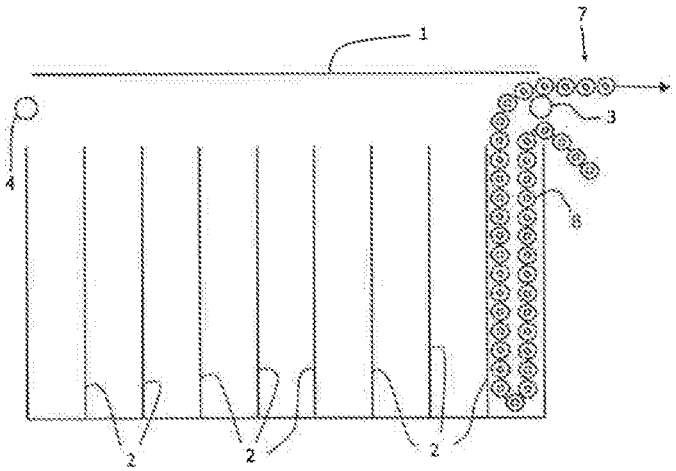
Figure 4:
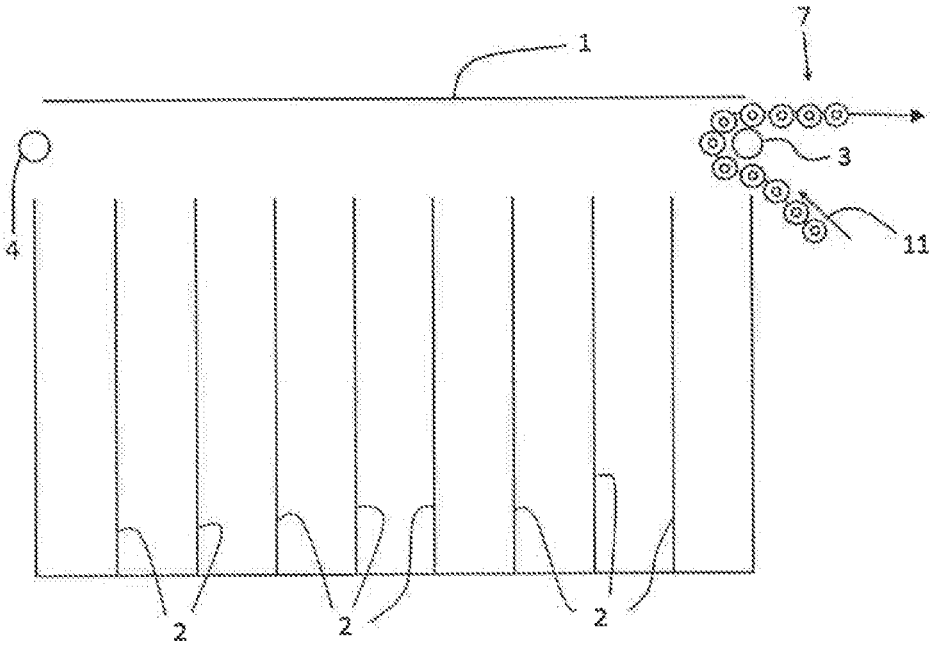
Figure 5:
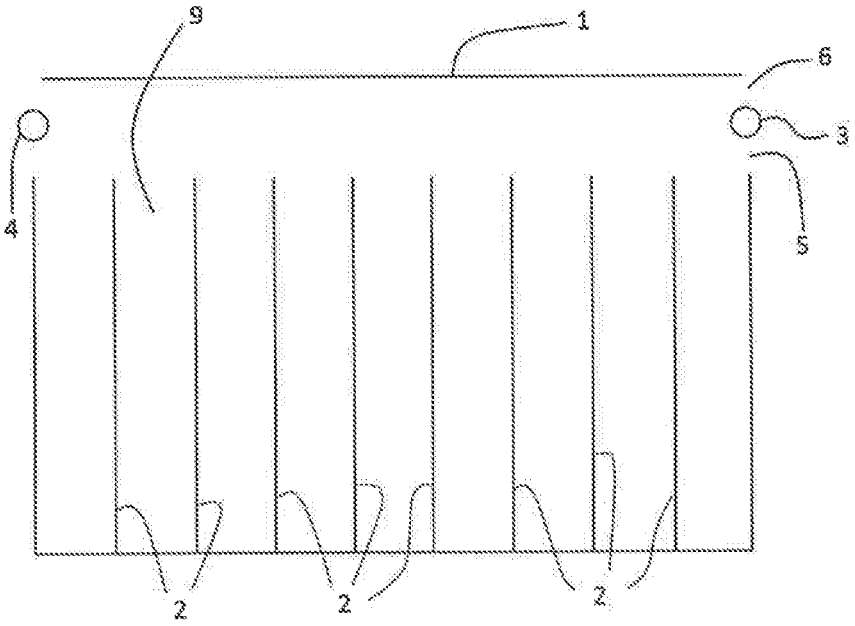
Figure 6:
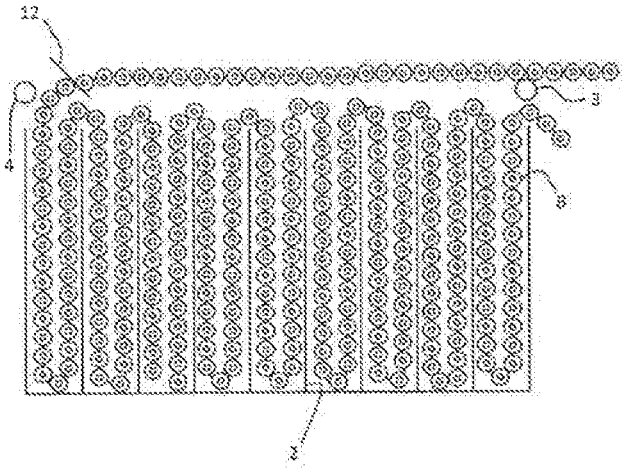
FIG. 6 show a cartridge box according to the invention, with the cover open in order to change the inlet/outlet side.
Figure 7:
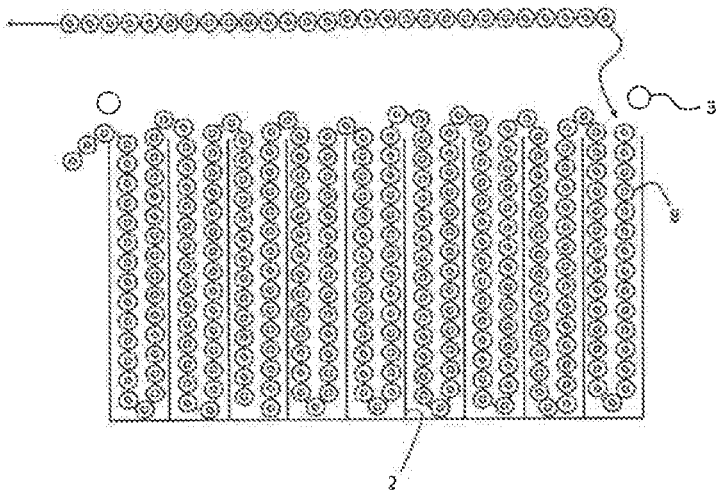
FIG. 7 shows the process of changing the inlet/outlet side.
Figure 8:
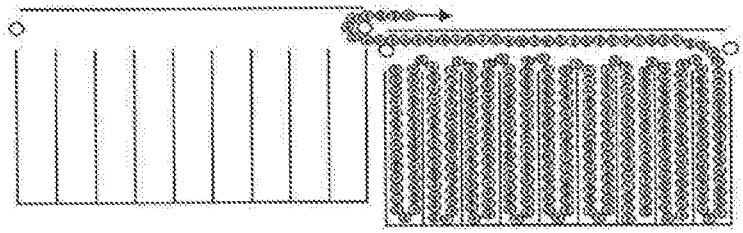
FIG. 8 shows two cartridge boxes according to the invention disposed in series.
Figure 9:
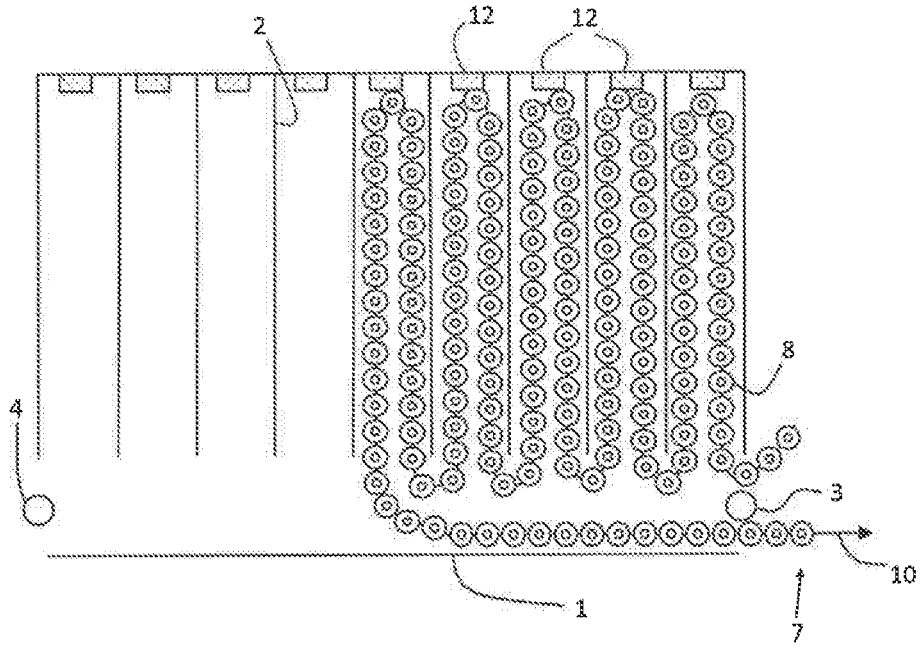
FIG. 9 shows a preferred embodiment of the invention, comprising magnets at the bottom of the compartments, the cartridge box being disposed "upside down".

The present invention relates to a cartridge box for ammunition in the form of a belt having links for connecting several boxes in series, such that it is possible to have as much space available as possible for feeding a machine gun or cannon, mainly for on-board applications.

To this end, the cartridge box of the invention comprises an inlet 5 and an outlet 6 separated by a turn roller 3, the inlet 5 being positioned above the outlet, on the same side of the box. The term "above" means here the top of the cartridge box positioned in the position intended for loading the box. In fact, it will be seen below that, according to preferred embodiments of the invention, the box can be positioned, in use, in virtually any position.

In order to make it easier to position the belt and easily unload the latter, the ammunition box of the invention comprises a plurality of compartments 9 separated by vertical partitions 2.

The belt 7 is initially positioned in a zigzag in the compartments 9, from the compartment close to the inlet 5 to the opposite side. The belt 7 is then folded up towards the outlet. This arrangement allows the belt 7 to slide over the top of the filled compartments 9, sliding over the cartridges, this avoiding a situation in which the links catch on the tops of the walls 2 of the empty compartments 9.

Advantageously, the bottom of the compartments 9 comprises a permanent magnet 12 for keeping the belt in position regardless of the position of the box 1. This makes it possible in particular to use the ammunition box in an inverted manner, the top of the box 1 as defined above being positioned underneath during use.

Figure 10:
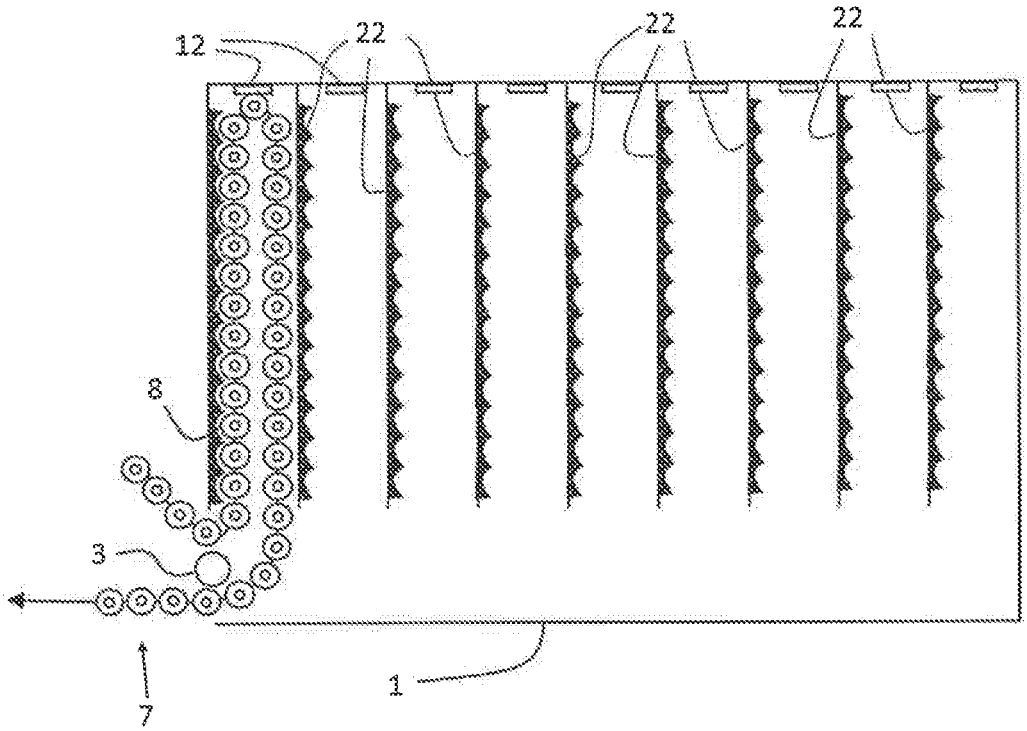
FIG. 10 shows another cartridge box according to the invention.

Still in the case of use "upside down" (i.e. with the inlet/outlet at the bottom of the device), it may be advantageous to position cells 23 on the side walls, on the face on the opposite side from the inlet/outlet. In this case, in the strand of the belt on the outlet side of the compartment that is being emptied can move freely towards the outlet (vertical movement in translation), the bottommost cartridge in the compartment carries out a rotational movement that is not impeded, while the strand on the cell side is retained by said cells. Such a configuration is shown in FIG. 10.

Advantageously, either the walls 22 having cells can easily be inverted or the cells 23 are disposed on removable plates that can easily be disposed on the right-hand side or left-hand side of the walls separating the compartments 9.

Preferably, the box 1 can also be inverted laterally (to the right/left with respect to the figures), the box 1 comprising an inlet and an outlet on each side face and a second turn roller 4 on the second side face.

In order to make it easy to load the cartridge box, the upper face is removable or can be fixed by means of a hinge, this not only making it easier to load the belt but also allowing it to be easier to change the inlet/outlet face.

Since the box comprises an inlet and an outlet on each face, two (or more) boxes can easily be connected in series, making it possible to optimize the space taken up by the ammunition, without there being a need for an additional feed device.

The invention claimed is:

1. An assembly of at least two cartridge boxes, each of the at least two cartridge boxes comprising:

a box comprising an inlet and an outlet, the outlet being positioned under the inlet and being separated therefrom by a turn roller; and a plurality of compartments separated by partitions; and the assembly further comprising:

a belt of cartridges, said belt of cartridges passing through the inlet, then being folded up in the plurality of compartments, from a compartment closest to the inlet to a farthest away compartment, the belt of cartridges then passing through the outlet, over the top of the turn roller;

wherein the belt of cartridges passing through the outlet of a first cartridge box enters the inlet of a second cartridge box.

2. The assembly of claim 1, wherein each of the at least two cartridge boxes comprises a removable cover for easy loading of the belt of cartridges.

3. The assembly of claim 1, wherein a permanent magnet is disposed at a bottom of each compartment of the plurality of compartments of each of the at least two cartridge boxes, each permanent magnet enabling the belt of cartridges to be secured in the compartment regardless of the position of the box.

4. The assembly of claim 1 wherein each cartridge box of the at least two cartridge boxes comprises a second inlet and a second outlet separated by a second turn roller on an opposite face of the box.

5. The assembly of claim 1, wherein in each cartridge box of the at least two cartridge boxes the partitions of the plurality of compartments comprise, on an opposite side of the cartridge box from the inlet and the outlet, cells for keeping a belt strand static during an unloading of the compartment.

6. A cartridge box comprising:

a box comprising an inlet and an outlet, the outlet being positioned under the inlet and being separated therefrom by a turn roller;

a plurality of compartments separated by partitions; and a belt of cartridges, said belt of cartridges passing through the inlet, then being folded up in the plurality of compartments, from a compartment closest to the inlet to a farthest away compartment, the belt of cartridges then passing through the outlet, over the top of the turn roller;

wherein a permanent magnet is disposed at a bottom of each compartment of the plurality of compartments, each permanent magnet enabling the belt of cartridges to be secured in the compartment regardless of the position of the box.

7. A cartridge box comprising:

a box comprising an inlet and an outlet, the outlet being positioned under the inlet and being separated therefrom by a turn roller;

a plurality of compartments separated by partitions;

a belt of cartridges, said belt of cartridges passing through the inlet, then being folded up in the plurality of compartments, from a compartment closest to the inlet to a farthest away compartment, the belt of cartridges then passing through the outlet, over the top of the turn roller; and a second inlet and a second outlet separated by a second turn roller on an opposite face of the box.

* * * * *